US011480144B2

(12) United States Patent
Asai

(10) Patent No.: US 11,480,144 B2
(45) Date of Patent: Oct. 25, 2022

(54) FUEL SUPPLY SYSTEM

(71) Applicant: DENSO CORPORATION, Kariya (JP)

(72) Inventor: Makoto Asai, Kariya (JP)

(73) Assignee: DENSO CORPORATION, Kariya (JP)

( * ) Notice: Subject to any disclaimer, the term of this patent is extended or adjusted under 35 U.S.C. 154(b) by 9 days.

(21) Appl. No.: 16/286,900

(22) Filed: Feb. 27, 2019

(65) Prior Publication Data

US 2019/0271288 A1 Sep. 5, 2019

(30) Foreign Application Priority Data

Mar. 5, 2018 (JP) ..... JP2018-38421

(51) Int. Cl.

| | |
|---|---|
| ***F02M 69/28*** | (2006.01) |
| ***F02M 59/20*** | (2006.01) |
| ***F02D 41/30*** | (2006.01) |
| ***F02M 37/08*** | (2006.01) |
| ***F02D 41/38*** | (2006.01) |
| ***F02D 41/32*** | (2006.01) |
| ***F02D 41/20*** | (2006.01) |
| ***F02N 11/08*** | (2006.01) |
| ***F02D 41/04*** | (2006.01) |

(52) U.S. Cl.

CPC ..... *F02M 69/28* (2013.01); *F02D 41/3082* (2013.01); *F02D 41/32* (2013.01); *F02D 41/3845* (2013.01); *F02D 41/3854* (2013.01); *F02M 37/08* (2013.01); *F02M 59/20* (2013.01); *F02D 41/042* (2013.01); *F02D 2041/2027* (2013.01); *F02D 2200/0602* (2013.01); *F02D 2250/02* (2013.01); *F02N 11/0814* (2013.01)

(58) Field of Classification Search

CPC .. F02M 37/08; F02M 2037/085; F02M 69/28; F02D 41/3082; F02D 41/32; F02D 41/3845

See application file for complete search history.

(56) References Cited

U.S. PATENT DOCUMENTS 5,406,922 A * 4/1995 Tuckey ..... F02D 41/3082 123/41.31
5,749,344 A 5/1998 Yoshiume et al.
2009/0224714 A1* 9/2009 Serizawa ..... H02P 7/29 318/434

(Continued)

FOREIGN PATENT DOCUMENTS

JP H6-257528 A 9/1994
JP 2004-19612 A 1/2004

(Continued)

*Primary Examiner* — Phutthiwat Wongwian
*Assistant Examiner* — Anthony L Bacon
(74) *Attorney, Agent, or Firm* — Posz Law Group, PLC

(57) ABSTRACT

A fuel supply system includes an electronic control unit that outputs a target fuel pressure for controlling a low-pressure pump and an engine status, and a fuel pump controller (FPC) that generates a drive signal for driving the low-pressure pump based on the target fuel pressure. The FPC is configured to obtain an actual fuel pressure, to set a duty ratio and to perform a feedback control for the actual fuel pressure to follow the target fuel pressure, and to set a lower limit guard value based on the engine status. The lower limit guard setter sets a duty ratio of 0% as the lower limit guard value when the engine status indicates a stop of the engine.

14 Claims, 6 Drawing Sheets

(56) References Cited

U.S. PATENT DOCUMENTS

| | | | | |
|---|---|---|---|---|
| 2015/0159577 | A1* | 6/2015 | Akita | F02D 33/003 123/497 |
| 2015/0330346 | A1* | 11/2015 | Tagawa | F02M 59/20 123/496 |
| 2016/0273505 | A1* | 9/2016 | Kojima | F02D 41/009 |
| 2018/0112619 | A1* | 4/2018 | Yang | F02D 41/123 |

FOREIGN PATENT DOCUMENTS

| | | | |
|---|---|---|---|
| JP | 2005-42649 | A | 2/2005 |
| JP | 2007-126986 | A | 5/2007 |
| JP | 2010-7477 | A | 1/2010 |
| JP | 2010-223072 | A | 10/2010 |
| JP | 2011-64093 | A | 3/2011 |
| JP | 2011-127494 | A | 6/2011 |
| JP | 2011-196262 | A | 10/2011 |
| JP | 2014-025445 | A | 2/2014 |
| JP | 2014-73777 | A | 4/2014 |
| JP | 2015-175276 | A | 10/2015 |
| JP | 2017-110605 | A | 6/2017 |

* cited by examiner

FUEL SUPPLY SYSTEM

CROSS REFERENCE TO RELATED APPLICATION

The present application is based on and claims the benefit of priority of Japanese Patent Application No. 2018-038421, filed on Mar. 5, 2018, the disclosure of which is incorporated herein by reference.

TECHNICAL FIELD

The present disclosure relates to a fuel supply system.

BACKGROUND INFORMATION

A vehicle with an internal combustion engine includes a fuel pump that pumps fuel stored in a fuel tank toward the internal combustion engine. Such fuel supply systems may include an engine control circuit (i.e., a control device, or a controller) that generates a control signal for controlling the fuel pump, and a pump drive circuit (i.e., a drive device, or a driver) that drives the fuel pump based on the control signal.

Electric power for operating the fuel pump driver may be provided by turning ON a relay to operate the fuel pump driver. Switching such a relay ON and OFF may create problems. As such, fuel supply systems are subject to improvement.

SUMMARY

The present disclosure describes a fuel supply system that reduces the number of times a relay for supplying electric power to a fuel pump controller is turned ON and OFF, while also maintaining the operability of the fuel pump controller when the internal combustion engine is stopped.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
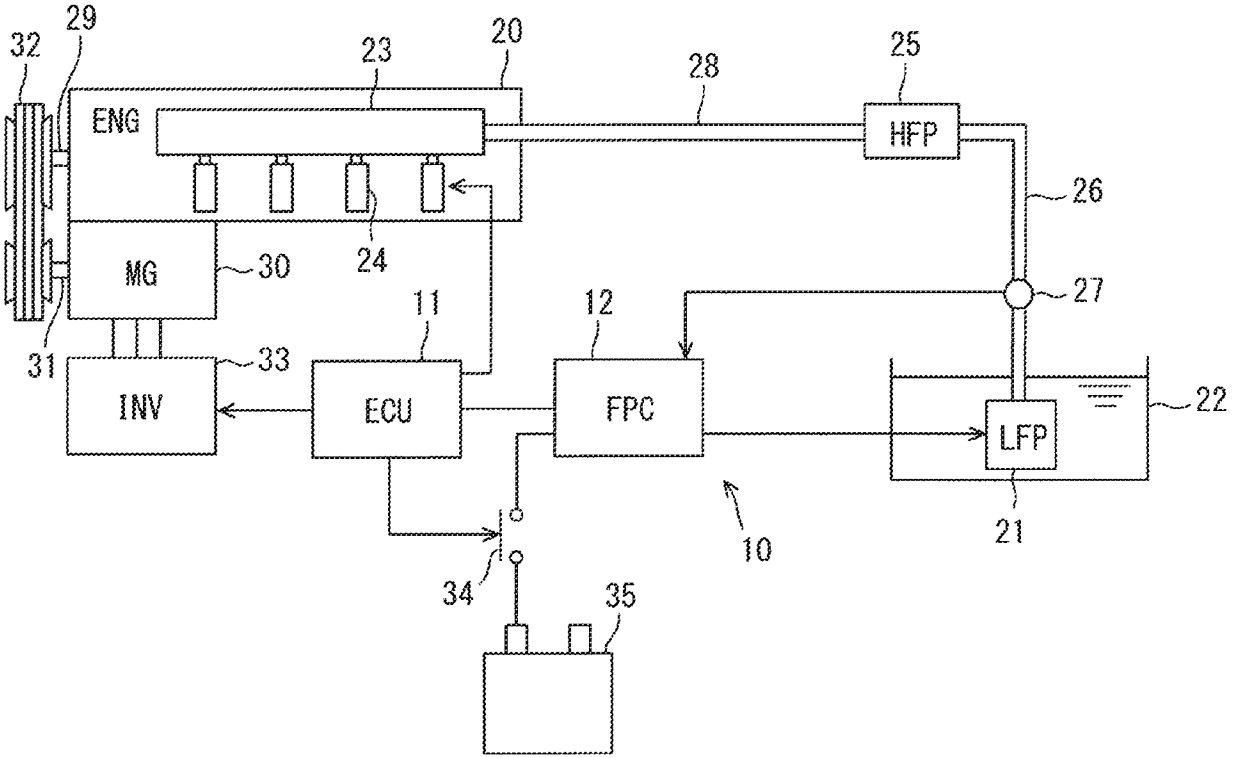
FIG. 1 illustrates a block diagram of a fuel supply system in a first embodiment of the present disclosure.

Electric power for operating a fuel pump controller (i.e., a fuel pump driver) may be provided by turning ON a relay to operate the fuel pump driver. In a conventional fuel supply system, switching the relay ON and OFF may be controlled by a controller, such as an electronic control unit (ECU) that may be considered as a higher level device compared to the fuel pump controller (FPC). In instances where the vehicle's engine stops (i.e., is turned OFF), the ECU turns OFF the relay to cut the electric power supply to the FPC, thereby stopping the fuel pump.

Vehicles that include greenhouse gas emission reduction technologies such as idle stop functions (also called engine start-stop systems and engine stop-start systems) may turn off the vehicle's engine during idling to reduce unnecessary fuel consumption and reduce emissions. In instances where a vehicle has an idle stop function, the relay for the FPC is turned OFF when the vehicle engine is turned OFF during an idle period (i.e., an idle stop). Likewise, in hybrid vehicles that have both an internal combustion engine and an electric motor as drive sources for driving/propelling the vehicle, the relay is turned OFF in the electric only (EV) travel mode where the vehicle is propelled by the electric motor alone.

In vehicles having an idle stop function and hybrid vehicles, problems may arise if the relay for the FPC is repeatedly turned ON and OFF (e.g., every time the vehicle's engine is stopped and restarted).

Problems may also arise if the FPC cannot be operated due to its electric power being cut off when the relay is turned OFF during an idle stop period.

In the fuel supply system of the present embodiment, an ECU outputs information regarding a target fuel pressure and operation state of the internal combustion engine to the FPC. The FPC sets the lower limit guard value of the duty ratio based on the operation state of the internal combustion engine. Then, when the operation state indicates a stop of the internal combustion engine when the vehicle ignition switch is ON, a preset duty ratio where the drive (i.e., operation) of the fuel pump is stopped, is set as the lower limit guard value. In such a way, when the vehicle engine is turned OFF due to an idle stop or the vehicle operating in the EV travel mode, the fuel pump can be stopped by the lower limit guard value of the duty ratio instead of turning OFF the relay. As such, the fuel supply system of the present disclosure reduces the number of times the relay is turned ON and OFF as compared to conventional systems. Additionally, since the relay is not turned OFF, the FPC can be kept in an operable state.

Hereinafter, a plurality of embodiments is described with reference to the drawings. In the embodiments, like parts and features described with reference to previous embodiments may be used in the description of the embodiments as indicated by the use of the same reference characters in the drawings and description. A repeat description of the like parts and features already described in a previous embodiment may be omitted from the description of subsequent embodiments.

First Embodiment

A schematic configuration of a fuel supply system of the present embodiment is described with reference to FIG. 1. FIG. 1 shows an engine control system including a fuel supply system in a vehicle having an idle stop function. An idle stop system that performs an idle stop function is a system that automatically shuts down and restarts an internal combustion engine in the vehicle to reduce the amount of time an engine spends idling. Such systems can reduce fuel consumption and emissions.

As shown in FIG. 1, a fuel supply system 10 is a system for supplying fuel to an engine 20 of a vehicle. The fuel supply system 10 includes an electronic control unit (ECU) 11 and a fuel pump controller (FPC) 12 in order to control a low-pressure fuel pump 21 for pumping fuel to/toward the engine 20. The engine 20 is an internal combustion engine.

The low-pressure fuel pump 21 may be referred to simply as a low-pressure pump 21 or fuel pump 21, shown as LFP 21 in FIG. 1. The ECU 11 may also be referred to more simply as a controller 11, and the FPC 12 may be referred to as a driver 12.

The low-pressure pump 21 is disposed in a fuel tank 22. The electric low-pressure pump 21 sucks (i.e., pumps) fuel from within the fuel tank 22, pressurizes the fuel with a relatively low pressure (for example, about 0.3 MPa), and then discharges the fuel toward a delivery pipe 23 (e.g., fuel distribution pipe/fuel rail) of the engine 20. A fuel injection valve 24 (i.e., injector) that supplies fuel to each cylinder of the engine 20 is connected to the delivery pipe 23.

A high-pressure fuel pump 25 is disposed between the low-pressure pump 21 and the delivery pipe 23. The fuel pump 25 of the high pressure system may be referred to as a high-pressure pump 25 (i.e., HFP 25 in FIG. 1). The low-pressure pump 21 and the high-pressure pump 25 are connected by a low-pressure fuel pipe 26. As such, the low-pressure pump 21 discharges the fuel to the low-pressure fuel pipe 26. A pressure sensor 27 is attached to the low-pressure fuel pipe 26. The pressure sensor 27 detects an actual fuel pressure of the fuel discharged from the low-pressure pump 21. That is, the actual fuel pressure may refer to a pressure of the fuel discharged from the low-pressure fuel pump 21.

The high-pressure pump 25 and the delivery pipe 23 are connected by a high-pressure fuel pipe 28. The high-pressure pump 25 pressurizes the fuel introduced from the low-pressure fuel pipe 26 with a relatively high pressure (for example, about 3.0 MPa), and then discharges the fuel to the delivery pipe 23 via the high-pressure fuel pipe 28. The high-pressure pump 25 is connected directly to a crankshaft 29 of the engine 20 and is driven based on the operation of the engine 20.

A motor generator (MG) 30 is provided integrally in the engine 20. The MG 30 is a rotating electric machine driven as an electric motor and a generator. A rotating shaft 31 of the MG 30 is connected to the crankshaft 29 of the engine 20 via a belt 32. When the engine 20 is started, initial rotation (i.e., cranking rotation) is given to the engine 20 by the rotation of the MG 30.

The MG 30 is connected to a battery 35 via an inverter 33 that is an electric power conversion circuit. When the MG 30 is driven as an electric motor, the electric power from the battery 35 is supplied to the MG 30 via the inverter 33. On the other hand, when the MG 30 functions as a generator, the electric power generated by the MG 30 is converted from AC (i.e., alternating current) to DC (i.e., direct current) by the inverter 33 and is then fed to the battery 35 for charging the battery 35. Such an MG 30 is also called an integrated-starter generator (ISG).

Based on travel information of the vehicle that includes information about the engine 20 detected by various sensors (not shown), the ECU 11 performs various controls such as engine control and a control of the inverter 33. Such controls may include controlling the opening degree of a throttle valve, controlling a fuel injection by the fuel injection valve 24, and controlling the ignition. Examples of the various sensors include a crank angle sensor, a cam angle sensor, an air-fuel ratio (A/F) sensor, a vehicle speed sensor, a brake sensor, an accelerator sensor, an intake air temperature sensor, a pressure sensor, an air flow meter, and a coolant temperature sensor.

The ECU 11 performs an idle stop control of the engine 20. When an idle stop condition is satisfied, the ECU 11 stops the engine 20, and when a restart condition is satisfied, the ECU 11 restarts the engine 20. For example, when the vehicle speed is equal to or less than a predetermined value and a brake operation is performed, the idle stop condition may be satisfied. When an accelerator operation begins, the restart condition may be satisfied.

The ECU 11 sets a target fuel pressure that is a target fuel pressure value based on the travel information of the vehicle, and outputs the target fuel pressure information as a control signal. The ECU 11 of the present embodiment also outputs information indicating the operation state of the engine 20 as an engine status. The engine status may be, for example, Run (i.e., where the engine 20 is in a rotational state), Stop (i.e., where the engine 20 is in a stop state), and Crank (i.e., where the engine 20 is in a cranking state). The ECU 11 distinguishes between these statuses and outputs the status corresponding to the operation state of the engine 20. Stop indicates a stop state of the engine 20 when the vehicle ignition switch is turned ON, that is, while the vehicle is driving/traveling. When the idle stop condition is satisfied, the ECU 11 outputs Stop as the engine status.

The ECU 11 of the present embodiment is an electronic controller (i.e., control unit) that includes a computer (not shown). The computer may be a small computer such as a microcontroller or a system on a chip (SoC). The computer includes, for example, a CPU, a ROM, a RAM, a register, and input/output (I/O) circuitry and ports (all not shown). However, the functions provided by the ECU 11 may be implemented as a combination of software stored in a tangible storage medium and executed by the computer, primarily as software, primarily as hardware, or as a combination of software and hardware. For example, when the functions/processes of the ECU 11 are implemented as hardware, the ECU 11 may include specialized circuitry for performing the functions, where the specialized circuitry may include digital circuit components, analog circuit components, and logical circuits configured to perform specialized functions associated with the ECU, where such functions and processes are described in greater detail below.

The FPC 12 becomes operable when the relay 34 is turned ON for supplying electric power from the battery 35 to the FPC 12. The relay 34 is a mechanical relay. The ON/OFF state of the relay 34 is controlled by the ECU 11 in the present embodiment. The ECU 11 turns ON the relay 34 when the ignition switch (not shown) is turned ON, and turns OFF the relay 34 when the ignition switch is turned OFF. When the engine 20 is stopped while the ignition switch is ON, the ECU 11 does not turn OFF the relay 34, but maintains the relay 34 in the ON state.

The FPC 12 drives the low-pressure pump 21. More specifically, the FPC 12 drives a motor of the low-pressure pump 21. The ECU 11 and the FPC 12 may communicate reciprocally with each other. In the present embodiment, for example, the ECU 11 and the FPC 12 can communicate mutually via a communication bus of an in-vehicle network using the CAN protocol. CAN is an abbreviation of a controller area network and is a registered trademark.

The FPC 12 obtains the target fuel pressure from the ECU 11 via the communication bus, and obtains the actual fuel pressure from the pressure sensor 27. Then, a feedback control is performed so that the actual fuel pressure conforms to (i.e., matches) the target fuel pressure, and a duty ratio of a drive signal is set. In the present embodiment, PI control is performed as the feedback control. Further, the FPC 12 sets a lower limit guard value for guarding a lower limit value of the duty ratio when setting the duty ratio. The FPC 12 sets the duty ratio so that the duty ratio does not fall below the lower limit guard value. That is, the duty ratio is set to a value that is at least greater than or equal to the lower limit guard value. The FPC 12 of the present embodiment sets a lower limit guard value based on the engine status.

The functions provided by the FPC 12 may, just like the ECU 11, be implemented as a combination of software stored in a tangible storage medium and executed by a computer, primarily as software, primarily as hardware, or as a combination of software and hardware. For example, when the functions/processes of the FPC 12 are implemented as hardware, the FPC 12 may include specialized circuitry for performing the functions, where the specialized circuitry may include digital circuit components, analog circuit components, and logical circuits configured to perform specialized functions associated with the FPC 12, where such functions and processes are described in greater detail below.

The process performed by the FPC 12 is described with reference to FIG. 2. When the ECU 11 turns ON the relay 34 when the ignition switch is turned ON, electric power is supplied from the battery 35 to the FPC 12, and the following process is performed.

At S10, the FPC 12 obtains the actual fuel pressure. When the FPC 12 performs the obtaining process at S10, the FPC 12 functions as an obtainer. As such, the FPC 12 may be referred to as an "obtainer" when performing the process at S10.

Next, at S20, the FPC 12 determines whether a CAN reception is performed. That is, the FPC 12 determines whether the target fuel pressure and the engine status are received.

If the FPC 12 determines that there is a CAN reception, i.e., "YES" at S20, the process proceeds to S30. At S30, the FPC 12 determines whether the engine status is Stop. For example, when the idle stop condition is satisfied, the FPC 12 determines that the engine 20 is in a stop state.

On the other hand, when the FPC 12 determines, for example, that there is no CAN reception within a preset reception period, i.e., "NO" at S20, the process proceeds to S40. At S40, the FPC 12 sets a preset value as the target fuel pressure.

At S30, when the engine status is Stop, i.e., "YES," the process proceeds to S50. At S50, the FPC 12 sets a duty ratio of 0% as the lower limit guard value. In the present embodiment, 0% is set as the preset duty ratio. At such duty ratio, the drive of the low-pressure pump 21 is stopped.

If however the engine status is not Stop, i.e., "NO" at S30, the process proceeds to S60. At S60, a duty ratio of 33% is set as the lower limit guard value.

It should be noted that the duty ratio set at S60 is not limited to 33%. A value higher than the duty ratio set at S50 may be set so that the low-pressure pump 21 can be driven. Thus, in the present embodiment, the lower limit guard value is set to 0% only in the stop period of the engine 20, and can be set to the example duty ratio of 33% in the other periods. When the FPC 12 performs the lower limit guard setting at S30, S50 and S60, the FPC 12 functions as a setter. As such, the FPC 12 may be referred to as a "lower limit guard setter" when performing the processes at S30, S50, and S60.

After setting the lower limit guard value at S50 or S60, the process proceeds to S70. At S70, the FPC 12 performs PI control, that is, a feedback control, and sets the duty ratio of the drive signal. The drive signal with the duty ratio is then output to the motor of the low-pressure pump 21. When the FPC 12 performs the duty ratio setting process at S70 the FPC 12 functions as a duty ratio setter and may be referred to as a "duty ratio setter" when performing the process at S70.

At S80, the FPC 12 determines whether the electric power is OFF. When the FPC 12 determines the electric power is OFF, i.e., "YES" at S80, the process shown in FIG. 2 ends.

If however the electric power is not OFF, i.e., "NO" at S80, the process returns to S10 and the above-described process is repeated. As a result, the FPC 12 will continue to perform the process shown in FIG. 2 so long as the FPC 12 determines that the electric power supply is still ON in S80.

Figure 3:
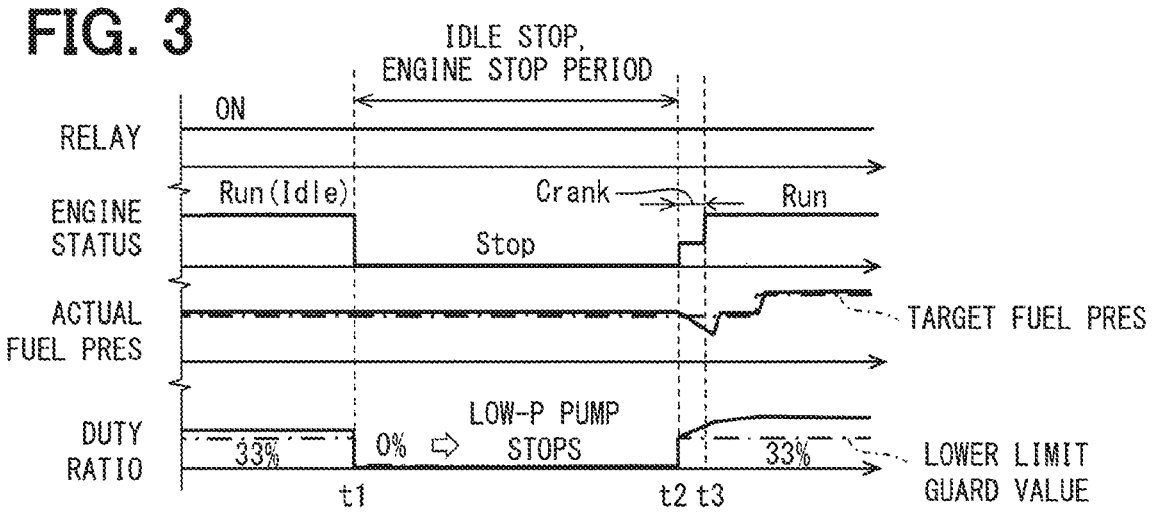
FIG. 3 is a timing chart including an idle stop period.

The operation of the fuel supply system 10 of the present embodiment is described with reference to FIG. 3. FIG. 3 shows a timing chart of a period including an idle stop. Starting at the top left-hand side of FIG. 3 and proceeding downward, the state of the relay 34, the engine status, the actual fuel pressure, and the duty ratio are shown.

For the actual fuel pressure, the target fuel pressure is shown as a one-dot-one-dash line under the actual fuel pressure, which is shown as a solid line. For the duty ratio, the lower limit guard value is shown by a one-dot-one-dash line under the duty ratio, which is shown as a solid line. Here, both the idle state (i.e., while the engine is idling) and the normal engine operation state (i.e., while the vehicle is driving/travelling) may be designated by the same engine status (Run).

When the idle stop condition is satisfied at time t1, the engine status switches from Run (Idle) to Stop, and the lower limit guard value switches from 33% to 0%. Since is the engine 20 is in an engine stop period here the engine 20 is stopped, the duty ratio becomes 0% during such period and the low-pressure pump 21 is stopped. In the example of FIG. 3, since the actual fuel pressure does not fall below the target fuel pressure during the engine stop period, the duty ratio is set to 0% during the engine stop period.

When the restart condition is satisfied at time t2 and the engine status switches from Stop to Crank by the switching of the lower limit guard value from 0% to 33%, the duty ratio is set to a value not less than the lower limit guard value of 33%, and the low-pressure pump 21 operates. Because the actual fuel pressure decreases due to the cranking, the duty ratio increases. The cranking then ends at time t3, and the engine status is switched from Crank to Run.

In the present embodiment, the ECU 11 outputs not only the target fuel pressure (i.e., control signal), but also the engine status. The FPC 12 sets the lower limit guard value of the duty ratio based on the engine status. When the engine status indicates Stop while the ignition switch is in an ON state, a preset duty ratio of 0%, where the drive of the low-pressure pump 21 is stopped is set as the lower limit guard value.

In such a way, when the engine 20 stops (e.g., during an idle stop period), the low-pressure pump 21 can be stopped by the lower limit guard value of the duty ratio instead of turning OFF of the relay 34 to stop the low-pressure pump 21. As a result, the fuel supply system 10 of the present embodiment reduces the number of times the relay 34 is switched ON/OFF, as compared to conventional systems. As such, the fuel supply system 10 of the present embodiment can reduce and limit failures caused by too much switching of the relay 34.

The relay 34 is not turned OFF when the engine 20 is stopped while the ignition switch is ON. As such, the FPC 12 can operate even during the engine stop. Thus, even when the engine is stopped, the FPC 12 can obtain the actual fuel pressure. Since the PI control is performed even when the engine is stopped, a decrease of the actual fuel pressure, for example, caused by a leak in the fuel supply system 10, will not prevent the operation of the low-pressure pump 21. During the restart of the engine 20, an initialization process for turning ON the electric power is unnecessary, and the omission of such an initialization process improves the restartability of the low-pressure pump 21.

Second Embodiment

The present embodiment may make reference to elements and features described in the preceding embodiment. As such, repeat descriptions of elements and features described in the preceding embodiment may be omitted from the description of the present embodiment.

Figure 4:
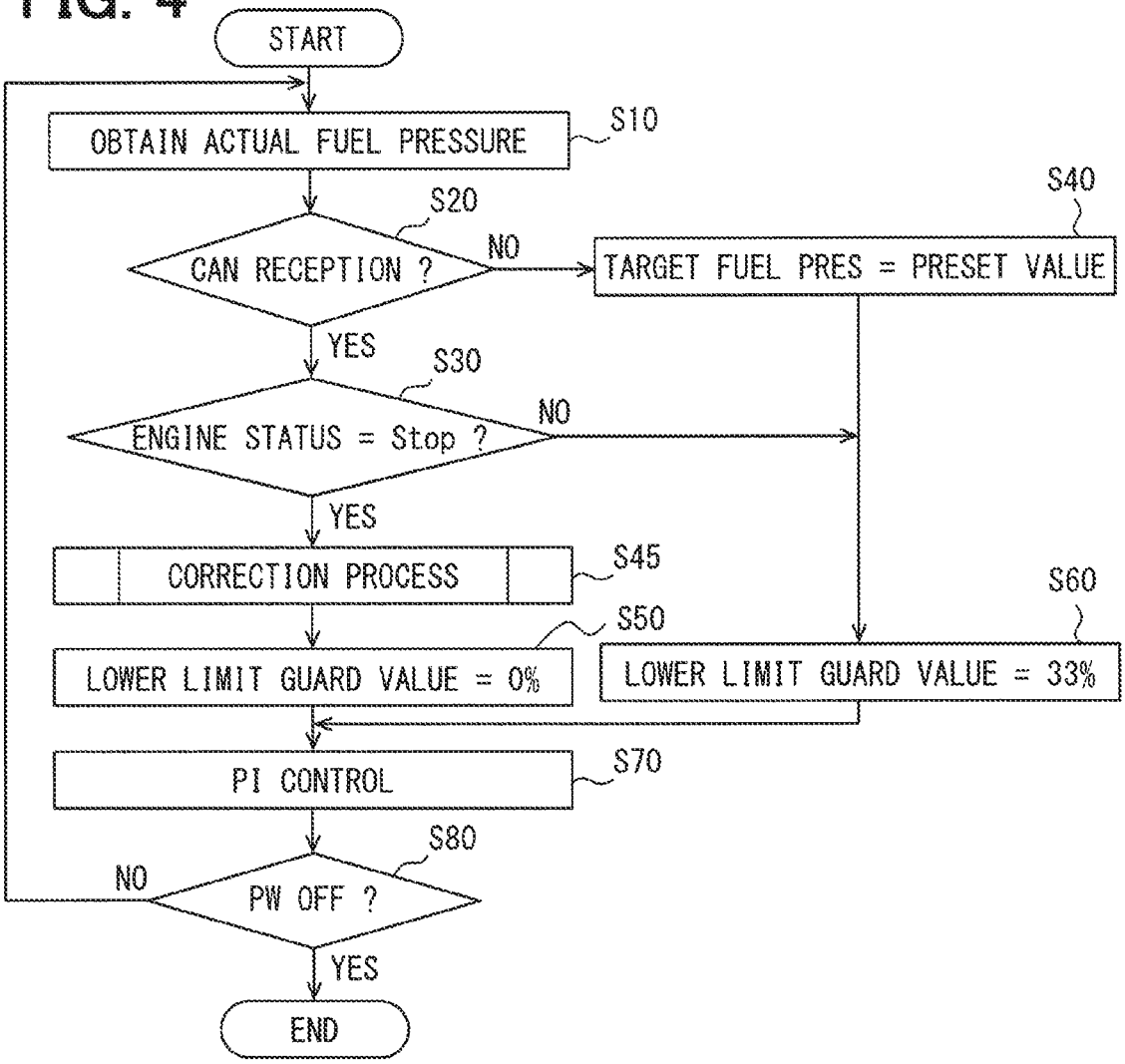
FIG. 4 is a flow diagram of a process performed by an FPC of a fuel supply system in a second embodiment of the present disclosure.

FIG. 4 shows a process performed by the FPC 12 in the fuel supply system 10 of the present embodiment. The processes at S10, S20, S30, S40, S50, S60, S70, and S80 shown in FIG. 4 are the same as those in the preceding embodiment described with reference to FIG. 2.

In FIG. 4, when the FPC 12 determines at S30 that the engine status is Stop, i.e., "YES" at S30, the process proceeds to S45. At S45, the FPC 12 performs a correction process for correcting the target fuel pressure before performing the process at S50. When the FPC 12 performs the correction process at S45, the FPC 12 functions as a corrector. As such, the FPC 12 may be referred to as a "target corrector" when it performs the process at S45.

Figure 5:
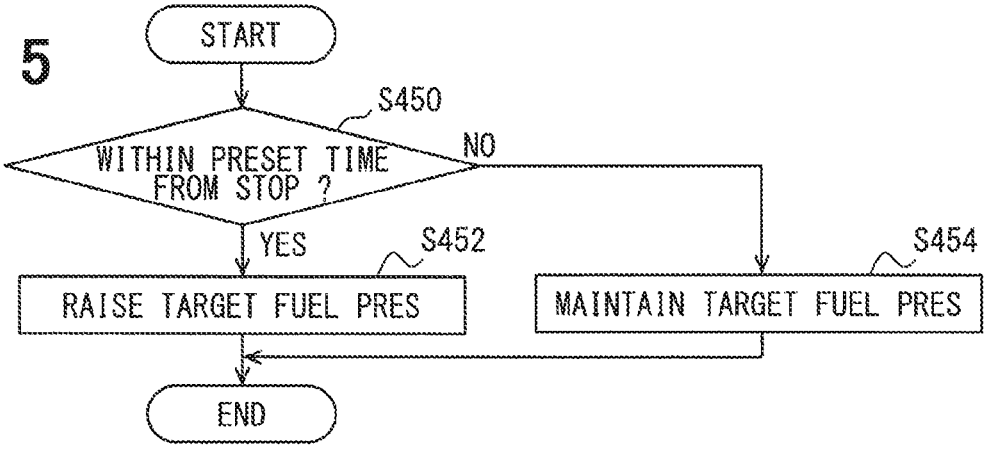
FIG. 5 is a flow diagram of a correction process.

FIG. 5 shows the correction process performed by the FPC 12. The FPC 12 may have, for example, a timer (not shown) for determining a count value. The timer starts counting when the engine status switches to Stop, and clears the count value when the Stop state ends, that is for example, when the engine 20 is restarted.

At S450, after the engine 20 stops and the counter of the FPC 12 begins counting, the FPC 12 determines whether the current count of the timer is within a preset time from when the engine 20 stops and the FPC 12 starts counting. For example, the preset time may be 2 seconds. In this case, the FPC 12 would determine at S450 whether the current count of the timer is within 2 seconds. In the case where the count of the timer occurs within the preset time, i.e., "YES" at S450, the process proceeds to S452. At S452, the received target fuel pressure is corrected. In this case, the FPC 12 raises the target fuel pressure to indicate a new target fuel pressure with a pressure value higher than the target fuel pressure received during the CAN reception at S20. In other words, the correction process increases the target fuel pressure to a higher pressure value. A predetermined value, for example, 200 kPa, may be added to the target fuel pressure at S452 to raise the target fuel pressure. After the correction at S452 the correction process then ends.

On the other hand, if the count value of the timer exceeds the preset time, i.e., "NO" at S450, the process proceeds to S454. At S454, the FPC 12 maintains the target fuel pressure received at S20 without any correction to the target fuel pressure. After performing the process at S454, the correction process then ends.

Figure 6:
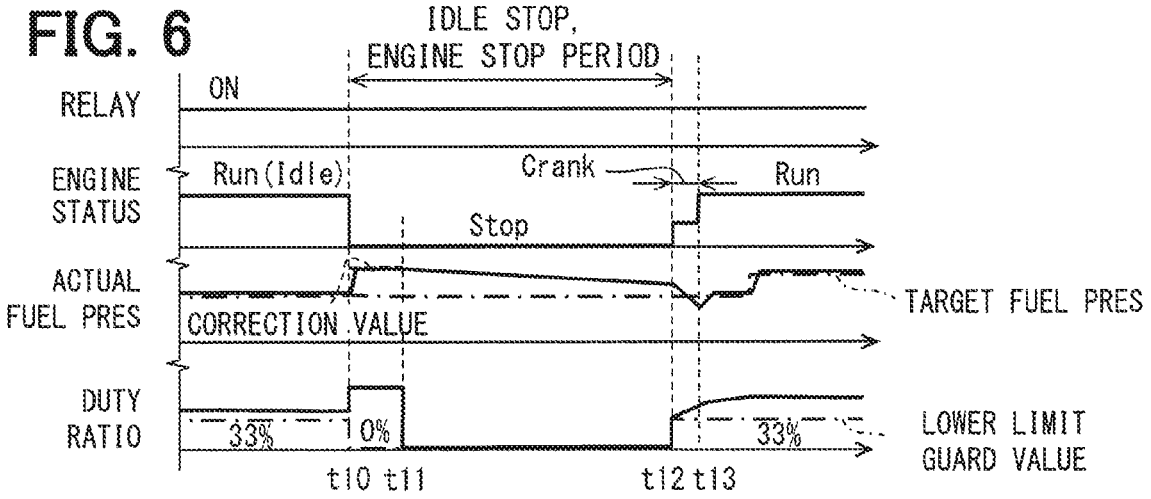
FIG. 6 is a timing chart including an idle stop period.

Next, the operation of the fuel supply system 10 of the present embodiment is described with reference to FIG. 6. The operation shown in FIG. 6 is similar to the operation of the previous embodiment shown in FIG. 3. As such, the times t10, t12, and t13 in FIG. 6 respectively correspond to the times t1, t2, and t3 in FIG. 3. FIG. 6 illustrates an example where the low-pressure pump 21 (or other element(s) in the system) may have a leak/leakage that may reduce the actual fuel pressure of the fuel.

When the idle stop condition is satisfied and the FPC 12 switches the engine status to Stop at time t10, the FPC 12 switches the lower limit guard value from 33% to 0%. In the present embodiment, as described above, the target fuel pressure is corrected by adding a predetermined correction value during a correction period from time t10 to time t11. In such manner, since the target fuel pressure is intentionally raised by the FPC 12, the duty ratio does not fall to the lower limit guard value of 0% during the period from time t10 to time t11, and the low-pressure pump 21 operates. As a result, the actual fuel pressure rises to the corrected target fuel pressure (i.e., the correction value).

At time t11, the period for correcting the target fuel pressure ends. Since the actual fuel pressure is higher than the target fuel pressure at time t11, the duty ratio is set to 0% until time t12. In the present embodiment, there may be leakage in the low-pressure pump 21 that causes the actual fuel pressure to gradually decrease. However, the low-pressure pump 21 stops after the correction until time t12 due to the effect of the initially-raised pressure. After time t12, the operation is the same as the preceding embodiment.

Thus, in the present embodiment, the FPC 12 corrects the target fuel pressure to a pressure value higher than the input target fuel pressure at least in part of the engine stop period. Then, a PI control is performed using the corrected target fuel pressure. As such, in addition to the effects described in the preceding embodiments, it is possible to further increase the actual fuel pressure.

In particular, in the present embodiment, the actual fuel pressure is increased for a preset time after stopping the engine 20, that is, at the beginning of the engine stop period. Consequently, even when the actual fuel pressure decreases due to leakage, the low-pressure pump 21 is stopped for an extended time period. When the actual fuel pressure falls below the target fuel pressure during the engine stop period, the low-pressure pump 21 repeats turning ON and OFF. According to the present embodiment, it is possible to limit/prevent the actual fuel pressure from falling below the target fuel pressure. Thus, it is possible to suppress the low-pressure pump 21 from repeatedly generating the motor noise while the engine is stopped (i.e., during an idle stop period). By keeping the low-pressure pump 21 ON less than usual during a pressure leak, electric power consumption can be reduced.

The present embodiment describes an example where a predetermined pressure value is added (i.e., at S452) to the target fuel pressure (i.e., received at S20) to calculate a corrected target fuel pressure. However, the present disclosure is not limited to adding a predetermined value to the received target fuel pressure for calculating a corrected target fuel pressure. For example, instead of using the target fuel pressure received at S20 as the basis for the corrected target fuel pressure, the target fuel pressure may be corrected to a preset constant value, e.g., 600 kPa. When the engine is stopped, the target fuel pressure typically takes a value lower than a median value of a normal operation range. Therefore, it may be preferable to set the constant value as a value higher than the median value, e.g., an upper limit value in the normal operation range or a value higher than the upper limit value of the normal operation range within a settable range.

Third Embodiment

The present embodiment may make reference to elements and features described in the preceding embodiments. As such, repeat descriptions of elements and features described in the preceding embodiments may be omitted from the description of the present embodiment.

The FPC 12 in the present embodiment also performs the correction process of step S45 (i.e., as shown in FIG. 4). That is, in the present embodiment, the FPC 12 may perform the process shown in FIG. 4, where the present embodiment substitutes the correction process shown in FIG. 7 for the correction process shown in FIG. 5.

Figure 7:
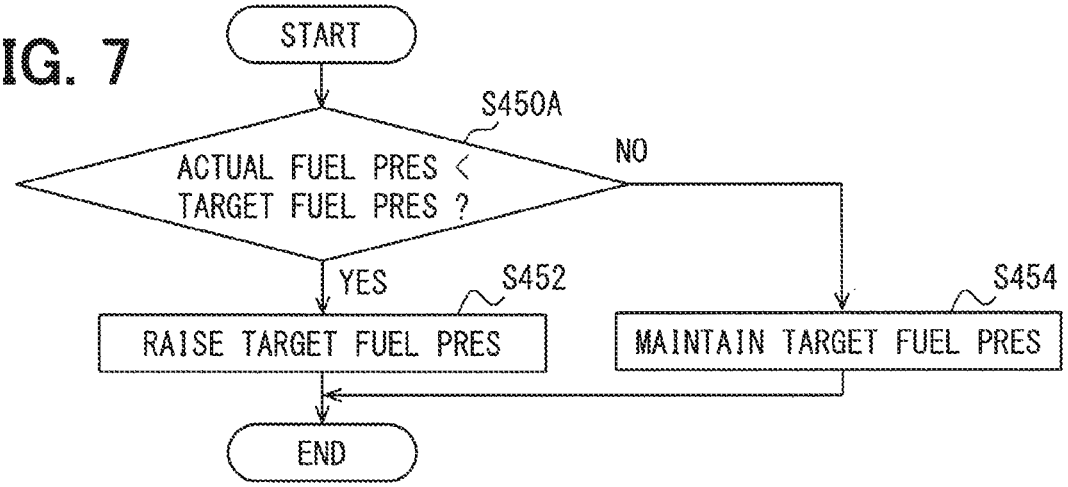
FIG. 7 is a flow diagram of a correction process performed by an FPC of a fuel supply system in a third embodiment of the present disclosure.

As shown in the correction process of FIG. 7, at S450A, the FPC 12 determines whether the actual fuel pressure falls below the target fuel pressure. If the FPC 12 determines that the actual fuel pressure is less than the target fuel pressure, i.e., "YES" at S450A, the process proceeds to S452. The FPC 12 performs the process at S452 in FIG. 7 just like S452 in FIG. 5 of the second embodiment. That is, the FPC 12 corrects the target fuel pressure by raising the target fuel pressure. The deviation between the corrected target fuel pressure and the actual fuel pressure becomes larger than the deviation between the received target fuel pressure and the actual fuel pressure, and the duty ratio is increased by such correction.

On the other hand, if the FPC 12 determines that the actual fuel pressure is not less than the target fuel pressure, i.e., "NO" at S450A, the process proceeds to S454. The FPC 12 performs the process at S454 in FIG. 7 similar to the process at S454 in FIG. 5 of the second embodiment. That is, the FPC 12 maintains the target fuel pressure received at S20 (i.e., in FIG. 4) without correcting the received target fuel pressure.

Figure 8:
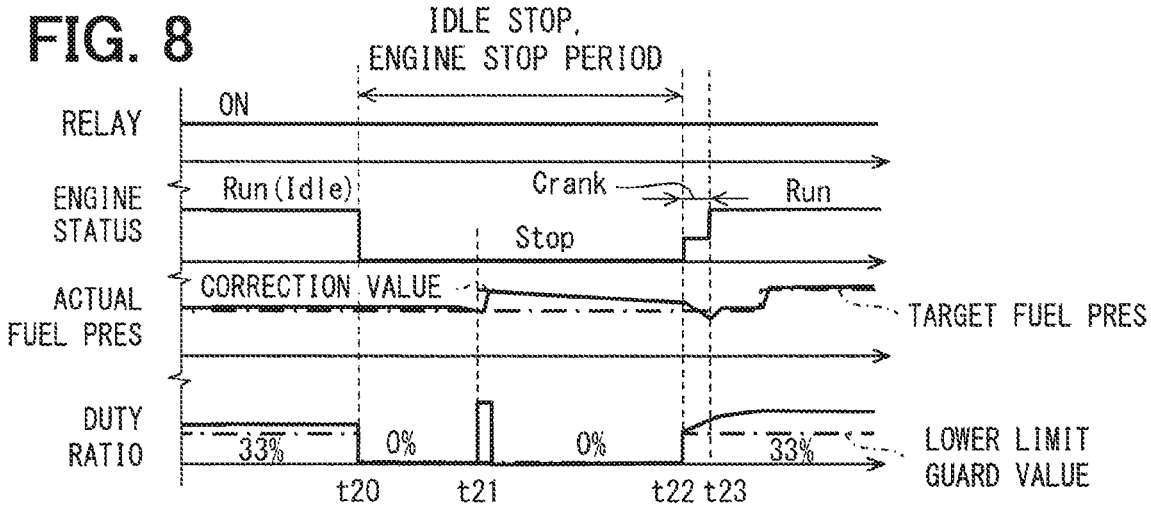
FIG. 8 is a timing chart including an idle stop period.

Next, the operation of the fuel supply system 10 of the present embodiment is described with reference to FIG. 8. The operation shown in FIG. 8 is similar to the operation of the first embodiment shown in FIG. 3. As such, the times t20, t22, and t23 in FIG. 8 respectively correspond to the times t1, t2, and t3 in FIG. 3.

When the idle stop condition is satisfied and the FPC 12 switches the engine status to Stop at time t20, the FPC 12 switches the lower limit guard value from 33% to 0%. As a result, the duty ratio becomes 0% and the low-pressure pump 21 stops.

When the actual fuel pressure decreases due to leakage and falls below the target fuel pressure at time t21, the target fuel pressure is corrected by adding a predetermined value. Then, the FPC 12 performs a PI feedback control based on the corrected target fuel pressure and the actual fuel pressure, and sets the duty ratio. The duty ratio becomes a value higher than the lower limit guard value 0%, and as a result, the low-pressure pump 21 operates and the actual fuel pressure rises. By correcting the target fuel pressure, the deviation between the actual fuel pressure and the target fuel pressure increases during the PI control, and as a result, the actual fuel pressure greatly exceeds the received target fuel pressure.

In the present embodiment, when there is leakage in the low-pressure pump 21, the actual fuel pressure gradually decreases. However, the actual fuel pressure does not fall below the target fuel pressure until time t22, at which time the engine stop period ends. At the time before time t22, as shown in FIG. 8, the duty ratio is 0% and the low-pressure pump 21 is OFF. After time t22, the operation is the same as those described in the previous embodiments (i.e., after time t2 in FIG. 3, and after time t12 in FIG. 6).

As described above, according to the present embodiment, as in the second embodiment, the actual fuel pressure is increased during the engine stop period. In particular, in the present embodiment, when the actual fuel pressure falls below the target fuel pressure in the middle of the engine stop period, the actual fuel pressure is increased compared to a PI control of the target fuel pressure without correction. As such, it is possible to limit/prevent the low-pressure pump 21 from repeatedly generating the motor noise while the engine is stopped, and electric power consumption can be reduced.

In the present embodiment, just like the second embodiment, the target fuel pressure may be corrected to a preset constant value. The present embodiment describes and illustrates an example where a correction of the target fuel pressure is performed only during a period in which the actual fuel pressure is lower than the target fuel pressure. However, such an example may be modified without limitation. For example, the target fuel pressure may be corrected for a preset period of time (i.e., preset duration) after the actual fuel pressure falls below the target fuel pressure.

The configuration described in the present embodiment may be combined with the configuration shown in the second embodiment.

Fourth Embodiment

The present embodiment may make reference to elements and features described in the preceding embodiments. As such, repeat descriptions of elements and features described in the preceding embodiments may be omitted from the description of the present embodiment.

Figure 9:
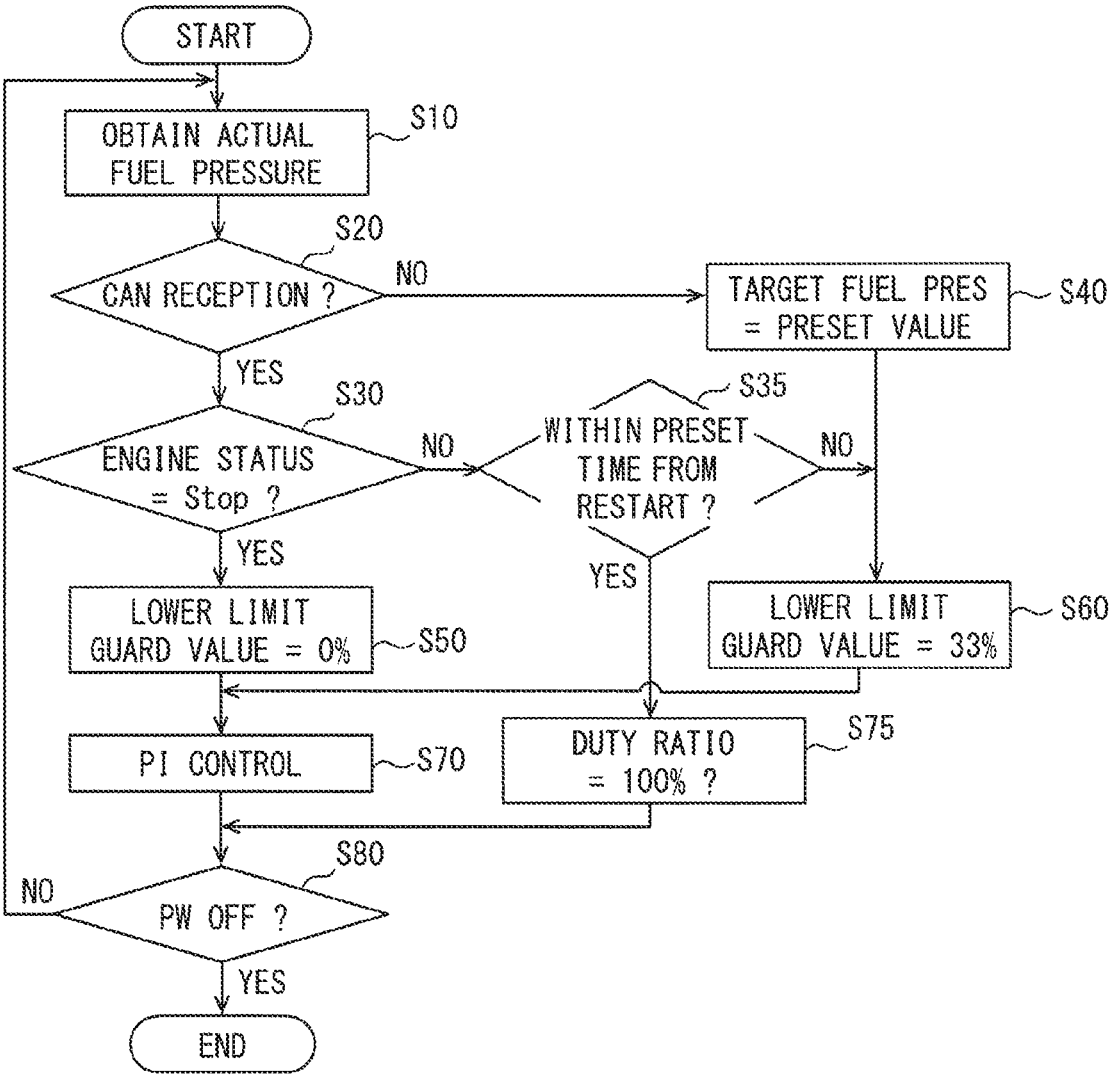
FIG. 9 is a flow diagram of a process performed by an FPC of a fuel supply system in a fourth embodiment of the present disclosure.

FIG. 9 shows a process performed by the FPC 12 in the fuel supply system 10 of the present embodiment. The processes at S10, S20, S30, S40, S50, S60, S70, and S80 shown in FIG. 9 are the same as the like-numbered processes described with reference to the previous embodiments.

As shown in FIG. 9, when the FPC 12 determines that the engine status is not Stop, i.e., "NO" at S30, the process proceeds to S35.

Similar to the previous embodiment, the FPC 12 in the present embodiment may have a timer. The timer starts counting when the engine status changes from Stop to Crank, and clears the count after a preset time elapses or when the engine status switches to Stop.

At S35, the FPC 12 determines whether its current count value is within a preset time after restarting the engine 20 (i.e., whether the current count value is within the preset time after the engine status switches from Stop to Crank). That is, the FPC 12 determines whether the current count value is within a preset time after the engine 20 returns to operation from the engine stop. When the FPC 12 performs the process to determine whether the current count value of the timer is within a preset time after a restart of the engine 20, the FPC 12 functions as a determiner. As such, the FPC 12 may be referred to as a "determiner" when it performs the process at S35.

When the current count value of the timer of the FPC 12 is within the preset time after the restart of the engine 20, i.e., "YES" at S35, the process proceeds to S75. At S75, the FPC 12 sets the duty ratio to a constant, preset value of 100% without performing the PI control at S70, and the process then proceeds to S80. The constant value is set to a value so as to be able to discharge any air inadvertently introduced into the low-pressure pump 21 or into the low-pressure fuel pipe 26 at the time of restarting the engine 20 after the engine stop. In the present embodiment, the upper limit of the settable duty ratio, i.e., 100%, is set as a constant value. However, the present invention is not limited to such a setting. An arbitrary value may be set as the constant value as long as the air in the pump 21 and the pipe 26 can be expelled during the restart of the engine 20. That is, as long as the motor can be rotated at a number of rotations necessary for removing any air from the pump 21 and the pipe 26.

In such manner, the duty ratio setter of the FPC 12 sets a duty ratio of 100% when the current count of the timer is within a preset time from restarting the engine 20, and otherwise sets the duty ratio by PI control.

If the FPC 12 determines that the current count value of the timer is not within the preset time after restarting the engine 20, i.e., "NO" at S35, the FPC 12 performs the process at S60.

In the present embodiment, due to the preset constant duty ratio that is set and used at the time of restarting the engine 20, the low-pressure pump 21 rotates at a predetermined number of rotations/revolutions, thereby expelling the air from the pump 21 and/or the pipe 26. As such, it is possible to limit and/or prevent drops in the actual fuel pressure due to the air in the system (i.e., in the pump 21 and pipe 26) to prevent insufficient power output from the engine 20.

The configuration described in the present embodiment may be combined with at least one of the configurations shown and described in the second and third embodiments.

Fifth Embodiment

The present embodiment may make reference to elements and features described in the preceding embodiments. As such, repeat descriptions of elements and features described in the preceding embodiments may be omitted from the description of the present embodiment.

With reference to FIG. 1, the fuel supply system 10 of the present embodiment can be applied to a hybrid vehicle having an electric motor (not shown) used as one of its power/propulsion sources, in addition to having the engine 20. In the case of the hybrid vehicle that includes an electric motor as its drive source, the ECU 11 may output information on the travel mode instead of the engine status, as information on the operation state of the engine 20. The travel mode includes at least an electric vehicle (EV) travel mode in which the vehicle is driven by the electric motor only with the engine 20 in a stopped state, and a hybrid vehicle (HV) travel mode in which the vehicle travels/drives with the engine 20 in an operated state.

Figure 2:
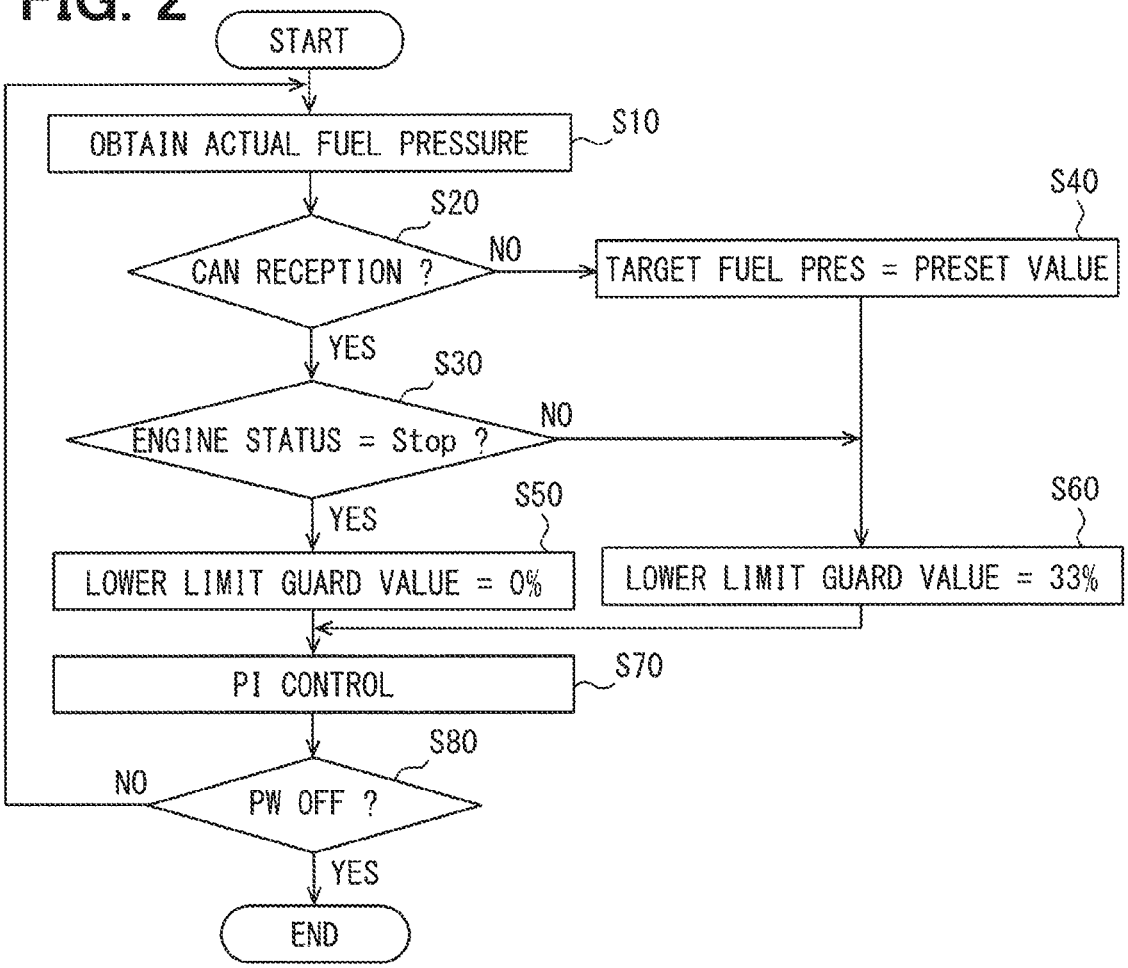
FIG. 2 is a flow diagram of a process performed by a Fuel Pump Controller (FPC)
Figure 10:
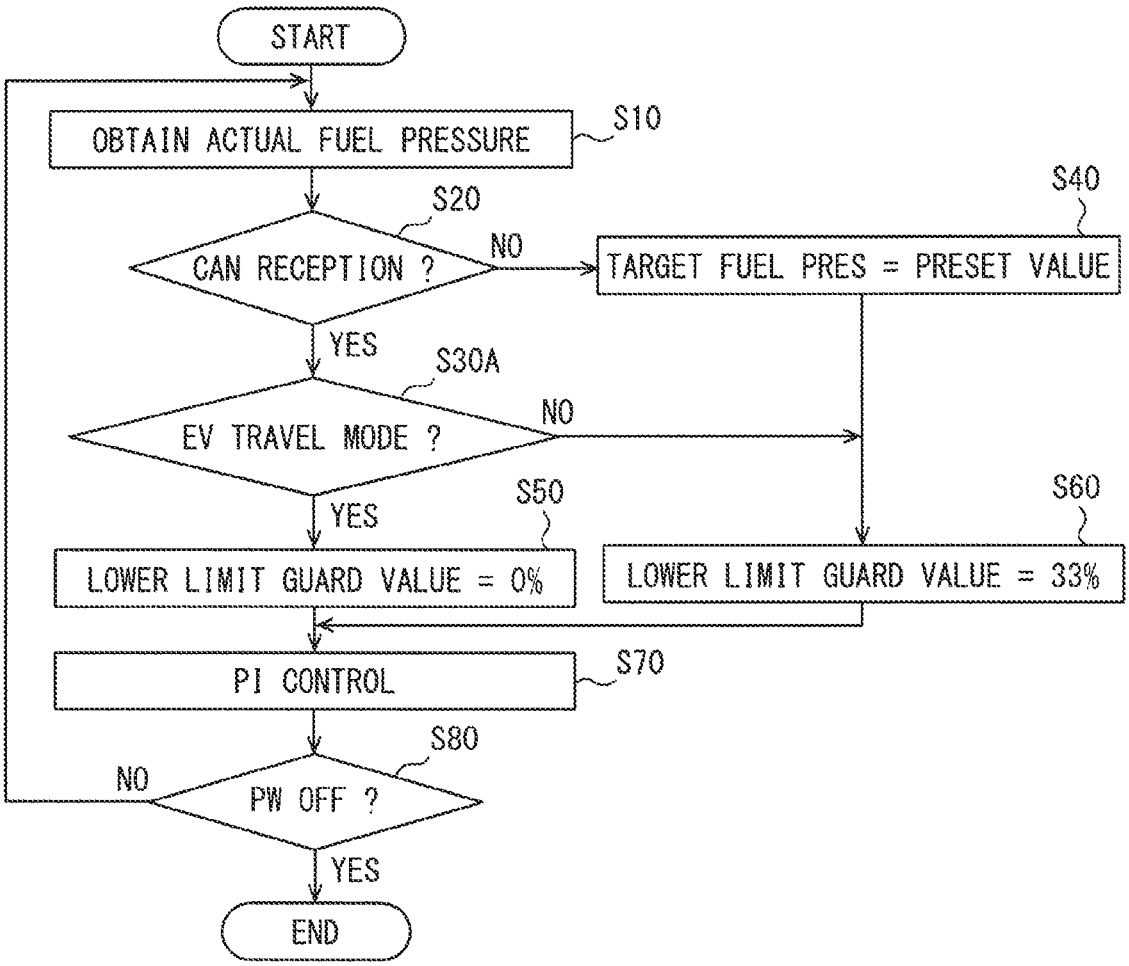
FIG. 10 is a flow diagram of a process performed by an FPC of a fuel supply system in a fifth embodiment of the present disclosure.

The processes of S10, S20, S40, S50, S60, S70, and S80 shown in FIG. 10 are the same as the like-numbered processes described in the first embodiment with reference to FIG. 2.

In FIG. 10, when the FPC 12 determines that there is a CAN reception, i.e., "YES" at S20, the process proceeds to 530A. At 530A, the FPC 12 then determines whether the travel mode is the EV travel mode.

When the FPC 12 determines that the travel mode is the EV travel mode, i.e., "YES" at 530A, the process proceeds to S50. At S50, the FPC 12 sets 0% as the lower limit guard value.

On the other hand, if the FPC 12 determines that the travel mode is not the EV travel mode, i.e., "NO" at S30A, the process proceeds to S60. At S60, the FPC 12 sets 33% as the lower limit guard value.

In the present embodiment, when the FPC 12 performs the processes at S30A, S50, and S60, the FPC 12 is determining how to set the lower limit guard value and functions as a lower limit guard setter. As such, the FPC 12 may be referred to as a "lower limit guard setter" when performing the processes at S30A, S50, and S60.

As described above, in the present embodiment, the ECU 11 outputs not only the target fuel pressure but also the travel mode. The FPC 12 sets the lower limit guard value of the duty ratio based on the travel mode. In the EV travel mode, a predetermined duty ratio of 0% is set as the lower limit guard value, at which the drive of the low-pressure pump 21 is stopped. By controlling when the drive of the low-pressure pump 21 can be stopped, the present embodiment can achieve the same effects as those described in the first embodiment.

The configuration described in the present embodiment can be combined with at least one of the configurations shown and described in the second, third, and fourth embodiments.

The present disclosure is not limited to the embodiments described above. The present disclosure encompasses the embodiments described above and modifications to the embodiments. For example, the present disclosure is not limited to the combination of elements shown in those embodiments. The present disclosure may be implemented in various combinations of the embodiments and the like. The disclosed technical scope is not limited to the description of the embodiments.

The FPC 12 described in the various embodiments may be a computer that may include, for example, a CPU, a ROM, a RAM, a register, input/output (I/O) circuitry and ports, communication circuits, and a timer/clock (all not shown). The ROM, RAM, and register may be examples of non-transitory, tangible storage mediums for storing software such as programs and instruction sets. The functions and processes performed by the FPC 12 may be performed when the CPU of the FPC 12 executes one or more programs or instruction sets stored in the non-transitory, tangible storage medium(s). Execution of such programs and instruction sets may cause the FPC 12 to perform the various process and functions described above, for example, as described and shown with reference to FIGS. 2, 4, 5, 7, 9, and 10. Though the FPC 12 may be configured to perform the processes and functions by executing a program/instruction set stored in its non-transitory, tangible storage media, the FPC 12 may also be configured with various specialized hardware for performing all or part of the above-described functions and processes. For example, when the functions/processes of the FPC 12 are implemented as hardware, the FPC 12 may include specialized circuitry for performing the functions, where the specialized circuitry may include digital circuit components, analog circuit components, and logical circuits configured to perform the specialized functions associated with the FPC 12. While the descriptions of the above embodiments describe the FPC 12 functioning as an "obtainer" when performing the process at S10, a "duty ratio setter" when performing the process at S70, a "lower limit guard setter" when performing the processes at S30, S30A, S50, and S60, a "target corrector" when performing the process at S45, and a "determiner" at S35, each of the obtainer, duty ratio setter, lower limit guard setter, target corrector, and determiner may be configured as specialized hardware circuits within the FPC 12 (all not shown). For example, the obtainer, duty ratio setter, lower limit guard setter, target corrector, and determiner may be configured as specialized circuits, application-specific integrated circuits (ASICs), field-programmable gate arrays (FPGAs), and like circuits, each with a hardware configuration for performing the above-described associated processes. That is, when configured as individual hardware circuits, the FPC 12 may include the obtainer, the duty ratio setter, the lower limit guard setter, the target corrector, and the determiner as separate hardware elements configured to perform the processes respectively associated with each of the elements.

The high-pressure pump 25 is, as an example, disposed at a position between the low-pressure pump 21 (i.e., fuel pump) and the engine 20. However, the position of the high-pressure pump 25 in the present disclosure is not limited to such a position.

In the above example, turning ON and OFF the relay 34 is controlled by the ECU 11. However, the present disclosure is not limited to such an example. The relay 34 may be turned ON and OFF when the ignition switch is turned ON and OFF.

Although the present disclosure is described by the above embodiments with reference to the accompanying drawings, it is to be noted that various changes and modifications will become apparent to those skilled in the art, and such changes, modifications, and summarized schemes are to be understood as being within the scope of the present disclosure as defined by appended claims.

What is claimed is:

1. A fuel supply system comprising:

a controller configured to output (i) information on a target fuel pressure for controlling a fuel pump, the fuel pump configured to pump fuel in a fuel tank toward an internal combustion engine and, (ii) information on an operation state of the internal combustion engine; and a driver configured to generate a drive signal for driving the fuel pump based on the target fuel pressure, a supply of electric power to the driver enabled by turning ON a relay, the driver including:

an obtainer configured to obtain information of an actual fuel pressure representing a pressure of the fuel discharged from the fuel pump;

a duty ratio setter configured to set a duty ratio of the drive signal and to perform a feedback control for the actual fuel pressure to follow the target fuel pressure; and a lower limit guard setter configured to set a lower limit guard value based on the operation state for limiting a lower limit value of the duty ratio and to keep the relay ON, wherein the lower limit guard setter is further configured to set, a preset duty ratio at which the drive of the fuel pump is stopped as the lower limit guard value when the operation state of the internal combustion engine indicates a stop of the engine when a vehicle ignition switch is ON, wherein the preset duty ratio at which the drive of the fuel pump is stopped as the lower limit guard value is a zero duty ratio, and the driver further includes a target corrector configured to correct the target fuel pressure to have a higher pressure value when the internal combustion engine is stopped.

2. The fuel supply system of claim 1, wherein the lower limit guard setter is further configured to set the preset duty ratio that stops the drive of the fuel pump as the lower limit guard value when the internal combustion engine stops due to a satisfaction of an idle stop condition.

3. The fuel supply system of claim 1, wherein the lower limit guard setter is further configured to set the preset duty ratio that stops the drive of the fuel pump as the lower limit guard value when the internal combustion engine stops due to an EV travel mode.

4. The fuel supply system of claim 1, wherein the target corrector is further configured to correct the target fuel pressure to have the higher pressure value within a preset time from an input of a stop signal that indicates a stop of the internal combustion engine.

5. The fuel supply system of claim 1, wherein the driver includes a determiner configured to determine whether a count value of a timer is within a preset time after a restart of the internal combustion engine, and the duty ratio setter is further configured to set the duty ratio to a value for driving the fuel pump to expel air from the fuel pump and a fuel passage.

6. A fuel supply system for use in a vehicle, the fuel supply system comprising:

a fuel pump configured to pump fuel in a fuel tank toward an internal combustion engine;

an electronic control unit configured to output target fuel pressure information for controlling the fuel pump and information regarding an operation state of the engine; and a fuel pump controller configured to generate a drive signal for driving the fuel pump based on the target fuel pressure, the fuel pump controller configured to:

obtain an actual fuel pressure of the fuel discharged from the fuel pump;

set a duty ratio of the drive signal;

perform a feedback control on the actual fuel pressure to match the actual fuel pressure to the target fuel pressure; and set a lower limit value for the duty ratio based on the operation state of the engine and to keep a relay that supplies electric power to the fuel pump controller ON, wherein the fuel pump controller is further configured to set a preset duty ratio as the lower limit value for stopping the fuel pump when the operation state of the engine indicates the engine is stopped and a vehicle ignition switch is ON, wherein the preset duty ratio at which the drive of the fuel pump is stopped as the lower limit guard value is a zero duty ratio, and the fuel pump controller is further configured to correct the target fuel pressure to have a higher pressure value when the internal combustion engine is stopped.

7. The fuel supply system of claim 6, wherein the fuel pump controller is further configured to set the preset duty ratio as the lower limit value for stopping the fuel pump when an idle stop condition for stopping the engine is satisfied and the engine stops.

8. The fuel supply system of claim 6, wherein the vehicle is configured as hybrid vehicle that includes an electric motor for propelling the vehicle, and wherein the fuel pump controller is further configured to set the preset duty ratio as the lower limit value for stopping the fuel pump when the vehicle is propelled by the electric motor and the engine stops.

9. The fuel supply system of claim 6, wherein the fuel pump controller includes a timer configured to determine a count value, and wherein the fuel pump controller is further configured to correct the target fuel pressure to have the higher pressure when the count value of the timer is within a preset time period that begins after the engine stops.

10. The fuel supply system of claim 6, wherein the fuel pump controller includes a timer configured to determine a count value, and wherein the fuel pump controller is further configured to determine whether the count value of the timer is within a preset time period after a restart of the engine and to set the duty ratio to a value for driving the fuel pump to expel air from the fuel pump and a fuel passage.

11. A fuel supply system controller comprising:

a processor; and a non-transitory computer-readable storage medium, wherein the controller is configured to:

obtain an actual fuel pressure, determine that an engine status is STOP, perform a correction process for a target fuel pressure to generate a corrected target fuel pressure, set a lower limit guard value and to keep a relay that supplies electric power to a fuel pump controller ON, and perform control of a duty ratio for a fuel pump based at least partially on the corrected target fuel pressure and/or the set lower limit guard value.

12. A fuel supply system controller comprising:

a processor; and a non-transitory computer-readable storage medium, wherein the controller is configured to:

obtain an actual fuel pressure, determine that an engine status is STOP, perform a correction process for a target fuel pressure to generate a corrected target fuel pressure, set a lower limit guard value, and perform control of a duty ratio for a fuel pump based at least partially on the corrected target fuel pressure and/or the set lower limit guard value, wherein the correction process includes:

determine whether an elapsed time from a beginning of the STOP engine status is within a preset time, upon a determination that the elapsed time is within the preset time, raise the target fuel pressure, and upon a determination that the elapsed time is NOT within the preset time, maintain the target fuel pressure.

13. The fuel supply system controller of claim 11, wherein the correction process includes:

determine whether the actual fuel pressure is less than the target fuel pressure, upon a determination that the actual fuel pressure is less than the target fuel pressure, raise the target fuel pressure, and upon a determination that the actual fuel pressure is NOT less than the target fuel pressure, maintain the target fuel pressure.

14. A driver of a fuel supply system to generate a drive signal for driving a fuel pump based on a target fuel pressure, a supply of electric power to the driver enabled by turning ON a relay, the driver comprising:

an obtainer configured to obtain information of an actual fuel pressure representing a pressure of a fuel discharged from the fuel pump;

a duty ratio setter configured to set a duty ratio of the drive signal and to perform a feedback control for the actual fuel pressure to follow the target fuel pressure;

a lower limit guard setter configured to set a lower limit guard value based on an operation state of an internal combustion engine for limiting a lower limit value of the duty ratio and to keep the relay ON, wherein the lower limit guard setter is further configured to set a preset duty ratio at which the drive of the fuel pump is stopped as the lower limit guard value when the operation state of the internal combustion engine indicates a stop of the engine when a vehicle ignition switch is ON, wherein the preset duty ratio at which the drive of the fuel pump is stopped as the lower limit guard value is a zero duty ratio; and a target corrector configured to correct the target fuel pressure to have a higher pressure value when the internal combustion engine is stopped.

* * * * *